US011798512B1

(12) United States Patent
Chen et al.

(10) Patent No.: US 11,798,512 B1
(45) Date of Patent: Oct. 24, 2023

(54) DISPLAY PANEL

(71) Applicant: WUHAN CHINA STAR OPTOELECTRONICS TECHNOLOGY CO., LTD., Wuhan (CN)

(72) Inventors: Xingru Chen, Wuhan (CN); Changwen Ma, Wuhan (CN); Pengfei Zhang, Wuhan (CN); Zhou Zhang, Wuhan (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 17/986,129

(22) Filed: Nov. 14, 2022

(30) Foreign Application Priority Data

Nov. 1, 2022 (CN) ..... 202211358259.4

(51) Int. Cl.
*G09G 3/00* (2006.01)
*G09G 3/36* (2006.01)

(52) U.S. Cl.
CPC ..... *G09G 3/3677* (2013.01); *G09G 3/3607* (2013.01); *G09G 3/3688* (2013.01); *G09G 2310/0278* (2013.01)

(58) Field of Classification Search
CPC .. G09G 3/20; G09G 5/00; G06F 11/10; H01L 27/12
See application file for complete search history.

(56) References Cited

U.S. PATENT DOCUMENTS

2018/0053464 A1* 2/2018 Lu ..... H01L 27/124
2020/0008153 A1* 1/2020 Yi ..... H04W 52/0261
2021/0158861 A1* 5/2021 Jeong ..... G11C 11/40615
2022/0036841 A1* 2/2022 Guo ..... G09G 3/3674

* cited by examiner

*Primary Examiner* — Michael A Faragalla
(74) *Attorney, Agent, or Firm* — The Roy Gross Law Firm, LLC; Roy Gross

(57) ABSTRACT

A display device is provided. The display device inputs a preset gray scale voltage to sub-pixels during a first time period within one frame in a second driving mode, thereby increasing a liquid crystal flipping speed within one frame, and therefore improving a response time of the display device in switching between black screen and white screen.

19 Claims, 8 Drawing Sheets

DISPLAY PANEL

CROSS REFERENCE TO RELATED APPLICATIONS

This application claims the benefit of priority of Chinese Application No. 202211358259.4 6 filed on Nov. 1, 2022. The contents of the above applications are all incorporated by reference as if fully set forth herein in their entirety.

BACKGROUND OF INVENTION

The present application relates to a field of display technology, and in particular, to a display panel.

BACKGROUND OF INVENTION

As a frame rate and a resolution of display screen continue to be improved, the closer to the last few lines of the display screen, the less time left for a liquid crystal to respond. It will lead to insufficient sub-pixel charging rate and make the display screen appear trailing when a respond time of the liquid crystal is less than a time required for the liquid crystal to flip.

In order to overcome the above defects, the currently technology proposes an over driver technology to make the liquid crystal in a shorter period of time to achieve a desired deflection target. Over driver technology is based on a principle that if a drive voltage is only provided to the target gray level, due to a slow response speed of the liquid crystal flip, the target gray scale cannot actually be achieved when a data signal on a data line needs to be switched from a current gray level to a target gray level. However, the over driver technology will provide a greater difference in the driving voltage corresponding to the current gray level, thus accelerating a speed of the LCD flip to achieve the actual target gray level we need, therefore a color shift problem can be solved.

However, although the over driver technology improves the gray level response time, it does not improve a response time for switching between black screen and white screen.

SUMMARY OF INVENTION

The present application provides a display device to improve a response time for switching between a black screen and a white screen.

The present application provides a display device including:

a plurality of scanning lines provided along a first direction;

a plurality of data lines provided along a second direction, wherein the plurality of scanning lines and the plurality of data lines crossing each other and enclosing a plurality of pixel regions, wherein each the pixel region is provided with a sub-pixel, and wherein the sub-pixel is electrically connected to the scanning line and the data line, respectively;

a first driving mode including: writing scanning signals line by line to the plurality of scanning lines within a next frame and inputting a gray scale voltage of the next frame to the sub-pixels through the data lines; and a second driving mode including: writing scanning signals to all the plurality of scanning lines simultaneously within a first time period of the next frame and inputting a preset gray scale voltage to the sub-pixels through the plurality data lines, and writing scanning signals to the plurality of scanning lines line by line within a second time period of the next frame and inputting the gray scale voltage of the next frame to the sub-pixels through the data lines, wherein the first time period is adjacent to the second time period;

wherein the display device is configured to adopt one of the first driving mode and the second driving mode within one frame.

Optionally, in some embodiments of the present application, the display device is configured to adopt the first driving mode within one frame when a difference between a first gray scale value of a current frame and a second gray scale value of the next frame is less than a set threshold;

wherein the display device is configured to adopt the second driving mode within the next frame when the difference between the first gray scale value of the current frame and the second gray scale value of the next frame is greater than or equal to the set threshold; and wherein an absolute value of the preset gray scale voltage is greater than an absolute value of a voltage value corresponding the first gray scale value when the absolute value of the voltage value corresponding the first gray scale value is less than an absolute value of a voltage value corresponding the second gray scale value, and wherein the absolute value of the preset gray scale voltage is less than the absolute value of the voltage value corresponding the first gray scale value when the absolute value of the voltage value corresponding the first gray scale value is greater than the absolute value of the voltage value corresponding the second gray scale value.

Optionally, in some embodiments of the present application, the first gray scale value is an average of gray scale values of last N rows of sub-pixels of the current frame, and wherein the second gray scale value is an average of gray scale values of last N rows of sub-pixels of the next frame.

Optionally, in some embodiments of the present application, the first gray scale value is a median of gray scale values of last N rows of sub-pixels of the current frame, and wherein the second gray scale value is a median of gray scale values of last N rows of sub-pixels of the next frame.

Optionally, in some embodiments of the present application, the first gray scale value is a gray scale value with a most occurrences in gray scale values of last N rows of sub-pixels of the current frame, and wherein the second gray scale value is a gray scale value with a most occurrences in gray scale values of last N rows of sub-pixels of the next frame.

Optionally, in some embodiments of the present application, the preset gray scale voltage is a voltage value corresponding to an average of gray scale values of last N rows of sub-pixels of the next frame.

Optionally, in some embodiments of the present application, the preset gray scale voltage is a voltage value corresponding to a gray scale value with a most occurrences in gray scale values of last N rows of sub-pixels of the next frame.

Optionally, in some embodiments of the present application, the first driving mode includes: writing scanning signals to the scanning lines line by line within the next frame, inputting a target gray scale voltage of the next frame to $1^{st}$ to $M\text{-}N^{th}$ rows sub-pixels through the data lines, and inputting an overdrive voltage to $M\text{-}N^{th}$ to $M^{th}$ rows sub-pixels, wherein an absolute value of the overdrive voltage is greater than an absolute value of a target gray scale voltage of $M\text{-}N^{th}$ to $M^{th}$ rows sub-pixels of the next frame, wherein M is a total number of rows of sub-pixels, and wherein N and M are positive integers.

Optionally, in some embodiments of the present application, the second driving mode includes: writing scanning signals to the scanning lines line by line within the second time period of the next frame, inputting a target gray scale voltage of the next frame to $1^{st}$ to M-$N^{th}$ rows sub-pixels through the data lines, and inputting an overdrive voltage to M-$N^{th}$ to $M^{th}$ rows sub-pixels, wherein an absolute value of the overdrive voltage is greater than an absolute value of a target gray scale voltage of M-$N^{th}$ to $M^{th}$ rows sub-pixels of the next frame, wherein M is a total number of rows of sub-pixels, and wherein N and M are positive integers.

Optionally, in some embodiments of the present application, N is less than or equal to an integer part of M/2, wherein M is a total number of rows of sub-pixels, and wherein M is a positive integer.

Optionally, in some embodiments of the present application, the second driving mode includes: inputting the preset gray scale voltage to each column of the sub-pixels respectively through the data lines, and wherein the preset gray scale voltage is a voltage value corresponding to a gray scale value with a most occurrences in each column of sub-pixels of the next frame.

Optionally, in some embodiments of the present application, the second driving mode includes: inputting the preset gray scale voltage to each column of the sub-pixels respectively through the data lines, and wherein the preset gray scale voltage is a voltage value corresponding to an average of the gray scale values of each column of the sub-pixels of the next frame.

The present application provides a display device, wherein the display device includes: a plurality of scanning lines provided along a first direction; a plurality of data lines provided along a second direction, wherein the plurality of scanning lines and the plurality of data lines crossing each other and enclosing a plurality of pixel regions, wherein each the pixel region is provided with a sub-pixel, and wherein the sub-pixel is electrically connected to the scanning line and the data line, respectively; a first driving mode including: writing scanning signals line by line to the plurality of scanning lines within a next frame and inputting a gray scale voltage of the next frame to the sub-pixels through the data lines; and a second driving mode including: writing scanning signals to all the plurality of scanning lines simultaneously within a first time period of the next frame and inputting a preset gray scale voltage to the sub-pixels through the plurality data lines, and writing scanning signals to the plurality of scanning lines line by line within a second time period of the next frame and inputting the gray scale voltage of the next frame to the sub-pixels through the data lines, wherein the first time period is adjacent to the second time period. The display device is configured to adopt one of the first driving mode and the second driving mode within one frame. In the present application, in the second driving mode, the preset gray scale voltage is input to the sub-pixel within the first time period of one frame, thereby increasing the liquid crystal flipping speed within one frame, and therefore improving a response time of the display device in switching between a black screen and a white screen.

DESCRIPTION OF FIGURES

In order to more clearly illustrate the technical solutions in the embodiments of the present application, the following will briefly describe the accompanying figures that need to be used in the description of the embodiments. It is obvious that the accompanying figures in the following description are only some embodiments of the present application, and other accompanying figures can be obtained according to these figures without inventive step for those skilled in the art.

DETAILED DESCRIPTION OF EMBODIMENTS

The following will be a clear and complete description of the technical solutions in the embodiments of the present application in combination with the accompanying figures in the embodiments of the present application. Obviously, the described embodiments are only a part of the embodiments of the present application, but not all of the embodiments. Based on the embodiments in the present application, all other embodiments obtained by those skilled in the art without inventive step shall fall within a protection scope of the present application.

In the description of the present application, it is understood that the terms "top", "bottom", "front", "back", "left", "right", "inside", "outside", etc. indicate an orientation or a positional relationship based on the orientation or the positional relationship shown in the accompanying figures and are intended only to facilitate and simplify the description of the present application, not to indicate or imply that the device or element referred to must have a particular orientation, be constructed and operated in a particular orientation, and therefore cannot be construed as a limitation of the present application. In addition, the terms "first" and "second" are used for descriptive purposes only and are not to be construed as indicating or implying relative importance or implicitly specifying a number of technical features indicated. Thus, the features "first" and "second" may explicitly or implicitly include one or more of the described features. In the description of the present application, "plurality" means two or more, unless otherwise expressly and specifically limited.

The present application provides a display device, which is described in detail below. It should be noted that an order in which the following embodiments are described is not intended to limit a preferred order of embodiments of the present application.

Figure 1:
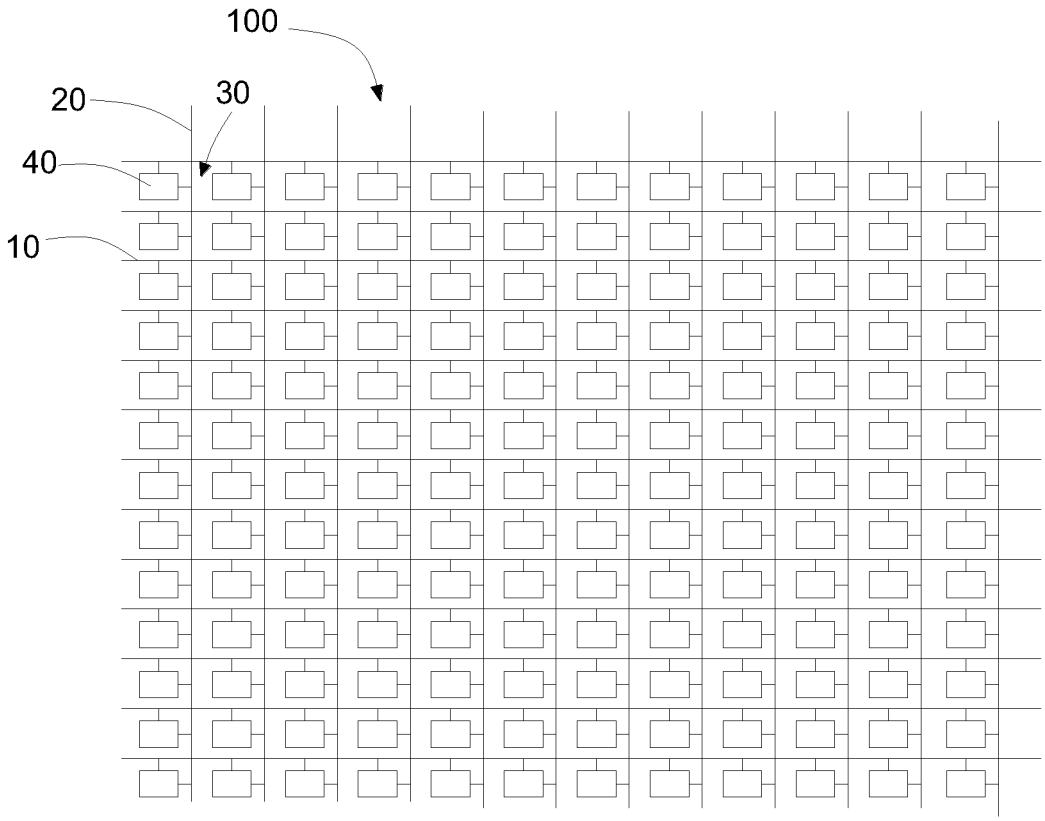
FIG. 1 is a schematic diagram of a display device provided in the present application.

Referring to FIG. 1, FIG. 1 is a schematic diagram of a display device 100 provided in the present application. The present application provides the display device 100, including:

a plurality of scanning lines 10 provided along a first direction;

a plurality of data lines 20 provided along a second direction, wherein the plurality of scanning lines 10 and the plurality of data lines 20 crossing each other and enclosing a plurality of pixel regions 30, wherein each the pixel region 30 is provided with a sub-pixel 40, and wherein the sub-pixel 40 is electrically connected to the scanning line 10 and the data line 20, respectively;

a first driving mode including: writing scanning signals line by line to the plurality of scanning lines 10 within a next frame and inputting a gray scale voltage of the next frame to the sub-pixels through the data lines 20; and a second driving mode including: writing scanning signals to all the plurality of scanning lines 10 simultaneously within a first time period of the next frame and inputting a preset gray scale voltage to the sub-pixels through the plurality data lines 20, and writing scanning signals to the plurality of scanning lines 10 line by line within a second time period of the next frame and inputting the gray scale voltage of the next frame to the sub-pixels 40 through the data lines 20, wherein the first time period is adjacent to the second time period;

wherein the display device 100 is configured to adopt one of the first driving mode and the second driving mode within one frame.

In the present application, in the second driving mode, a preset gray scale voltage is input to the sub-pixels 40 within the first time period of a frame, and the preset gray scale voltage enables all the sub-pixels 40 of the display device 100 to be charged to a certain voltage in advance before the sub-pixels 40 are scanned line by line, thus increasing a liquid crystal flipping speed of one frame, and therefore a response time of the display device 100 in switching between black and white screens can be improved.

Further, in some embodiments, the display device 100 is configured to adopt the first driving mode within one frame when a difference between a first gray scale value of a current frame and a second gray scale value of the next frame is less than a set threshold; wherein the display device 100 is configured to adopt the second driving mode within the next frame when the difference between the first gray scale value of the current frame and the second gray scale value of the next frame is greater than or equal to the set threshold; and wherein an absolute value of the preset gray scale voltage is greater than an absolute value of a voltage value corresponding the first gray scale value when the absolute value of the voltage value corresponding the first gray scale value is less than an absolute value of a voltage value corresponding the second gray scale value, and wherein the absolute value of the preset gray scale voltage is less than the absolute value of the voltage value corresponding the first gray scale value when the absolute value of the voltage value corresponding the first gray scale value is greater than the absolute value of the voltage value corresponding the second gray scale value.

Figure 2:
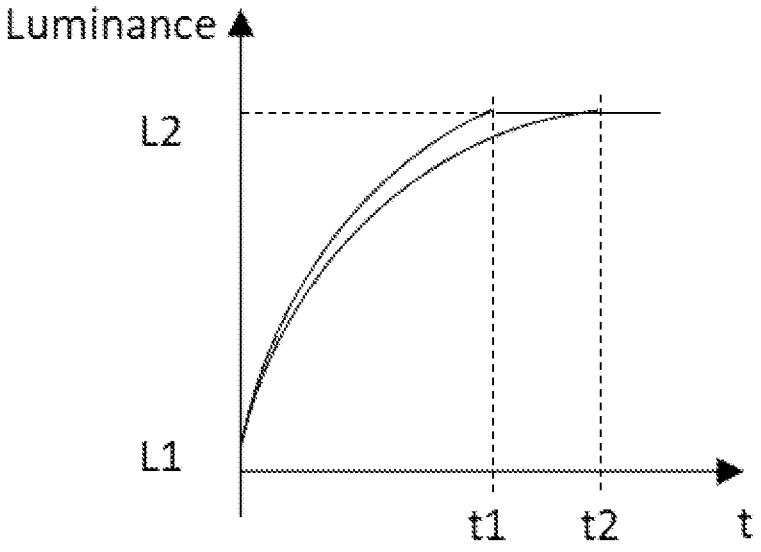
FIG. 2 is a schematic diagram of luminance of a sub-pixel when charging the sub-pixel by using an overdrive technique.

Referring to FIG. 2, FIG. 2 is a schematic diagram of luminance of a sub-pixel 40 when charging the sub-pixel 40 by using an overdrive technique. As shown in FIG. 2, time required for sub-pixel 40 to reach L2 luminance when charging sub-pixel 40 with overdrive technology is t1, while time required for sub-pixel 40 to reach L2 luminance when charging sub-pixel 40 without overdrive technology is t2. t1 is much less than t2, therefore overdrive technology can improve an intergradient response time of sub-pixel 40. However, since a maximum value that can be boosted by the overdrive technique is a white screen voltage value or a black screen voltage value, it has no effect on the response time of switching between a black screen and a white screen. In contrast, in the present application, the current frame can be one of the black screen and the white screen and the next frame can be the other of the black screen and the white screen when a difference in luminance between a current frame and the next frame is large. A preset gray scale voltage is input to the sub-pixel 40 during the first time period of the next frame, and since the preset gray scale voltage is input to the sub-pixel 40 in advance, it is possible to reduce the difference between the gray scale value of sub-pixel 40 and the gray scale value of the next frame, and thus a charging time of sub-pixel 40 can be reduced, and thus the response time can be improved, in particular the response time for switching between the black screen and the white screen.

Specifically, in some embodiments, the setting threshold is greater than or equal to 32, i.e., the preset gray scale voltage is input to the sub-pixel 40 within the first time period of the next frame when the difference between the first gray scale value and the second gray scale value is greater than or equal to 32. Further, the setting threshold can be set according to actual needs.

That is, if the difference between the luminance of the current frame and the luminance of the next frame is greater, a difference between a gray scale value of the current frame and a gray scale value of the next frame is also greater. Therefore, a transition between the current frame and the next frame will result in the charging voltage of the sub-pixel 40 does not reach the target gray scale voltage due to insufficient charging time. For the above situation, the present application inputs a preset gray scale voltage to all sub-pixels 40 during the first time period of the next frame when a value of the difference is greater than or equal to the set threshold, and the absolute value of the preset gray scale voltage is greater than the absolute value of the voltage value corresponding to the first gray scale value when the absolute value of the voltage value corresponding to the first gray scale value is less than the absolute value of the voltage value corresponding to the second gray scale value. The absolute value of the preset gray scale voltage is less than the absolute value of the voltage value corresponding to the first gray scale value when the absolute value of the voltage value corresponding to said first gray scale value is greater than the absolute value of the voltage value corresponding to the second gray scale value, and the gray scale voltage of the next frame is input to the sub-pixel 40 within the second time period of the next frame. Since the preset gray scale voltage is input to the sub-pixel 40 in advance, thereby it is possible to reduce the difference between the gray scale value of the sub-pixel 40 and the gray scale value of the next frame within the next frame time, thus reducing a charging time of the sub-pixels 40 and thus improving the response time, in particular improving a response time of the transition between the black screen and the white screen.

The gray scale value of the next frame is input to the sub-pixel 40 during the first time period and the second time period of the next frame when the difference is less than the set threshold. Specifically, since the difference between the gray scale value of the current frame and the next frame is not significant, the target gray scale voltage of the next frame is input to the sub-pixel 40 within the first time period and the second time period of the next frame, and also the overdrive voltage can be input to the sub-pixel 40 during the first time period and the second time period of the next frame. The target gray scale voltage is a voltage required to charge the sub-pixel 40 to reach the target luminance when displaying the frame. The target gray scale voltage is determined based on the gamma curve used by the display device and the pre-written correspondence between gray scale and voltage. The overdrive voltage is greater than the target gray scale voltage of the sub-pixel 40, causing the liquid crystal corresponding to the sub-pixel 40 to be deflected quickly so that the voltage of the sub-pixel 40 can be charged to the target gray scale voltage using a shorter charging time. The gray scale voltage of the next frame is also determined based on the gamma curve used by the display device and the pre-written correspondence between gray scale and voltage.

Figure 3:
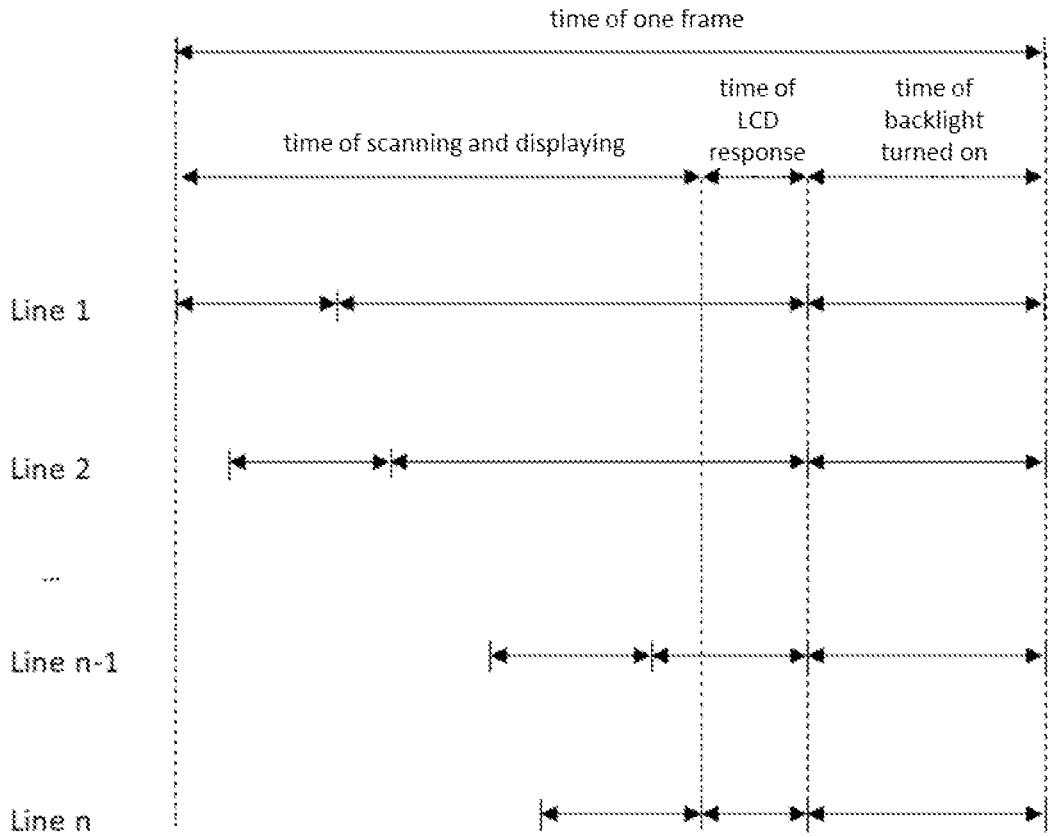
Prior Art FIG. 3
FIG. 3 is a schematic diagram of a time sequence of a currently liquid crystal display device during one frame.
Figure 7:
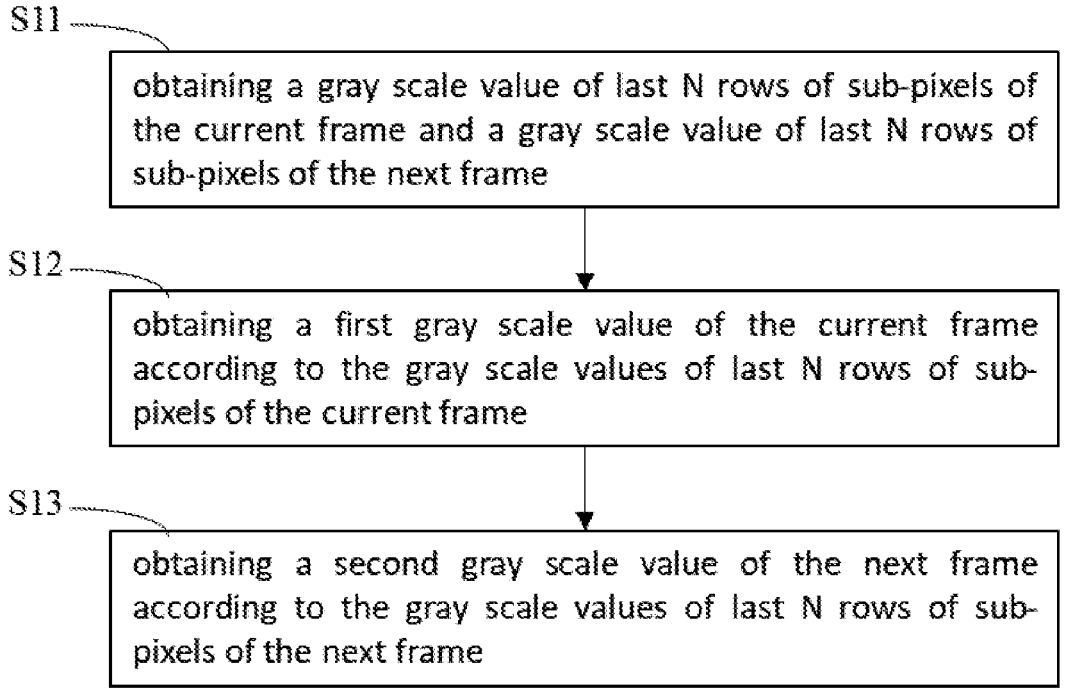
FIG. 7 is a flowchart of one embodiment of step S10 of the charging method of the sub-pixels provided in the present application.

Referring to FIG. 3, FIG. 3 is a schematic diagram of a time sequence of a currently liquid crystal display device 100 during one frame. Since the LCD device 100 is scanned line by line, the liquid crystal corresponding to the row sub-pixel 40 near a start of the scanning has more response time, while the liquid crystal corresponding to the row sub-pixel 40 near an end of the scanning has less response time. That is, the liquid crystal response time becomes less as the number of display lines increases. Referring to FIG. 7, response time of the LCD corresponding to line 1 sub-pixel 40 is a longest, while response time of the LCD corresponding to line n sub-pixel 40 is a shortest, therefore line 1 sub-pixel 40 has enough time for charging, while line n sub-pixel 40 has insufficient charging time. Therefore, the present application obtains a first gray scale value of the current frame based on gray scale values of last N rows of sub-pixels 40 of the current frame, then obtains a second gray scale value of the next frame based on gray scale values of last N rows of sub-pixels 40 of the next frame, and then obtains a difference between an absolute value of the first gray scale value and an absolute value of the second gray scale value. That is, determining whether to input the preset gray scale voltage to the sub-pixel 40 based on the difference between gray scale values of last N rows of sub-pixels 40 of the current frame and gray scale values of last N rows of sub-pixels 40 of the next frame, allowing for a more accurate charging effect of sub-pixel 40.

Figure 4:
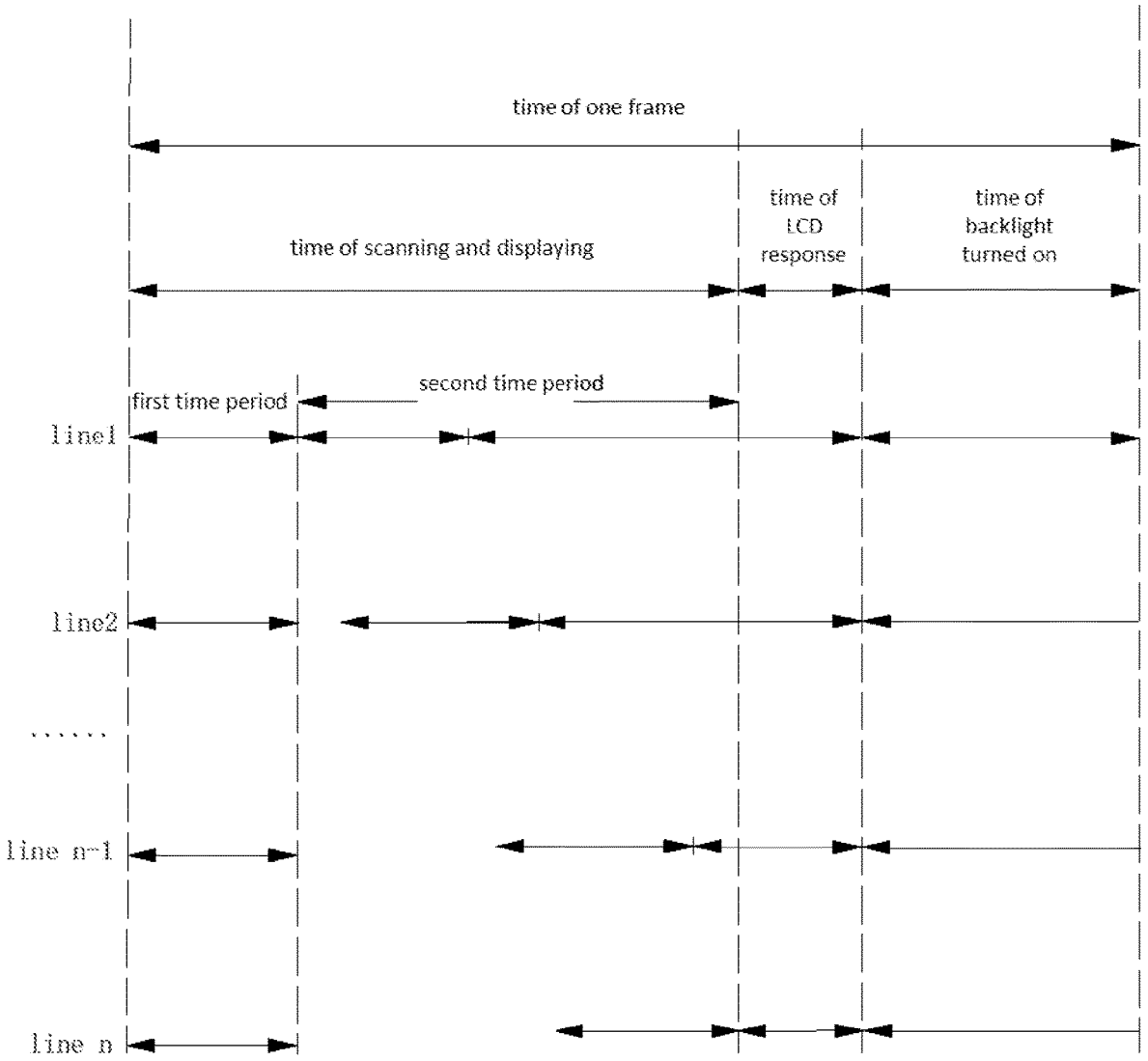
FIG. 4 is a schematic diagram of a time sequence of the display device of the present application during one frame.
Figure 5:
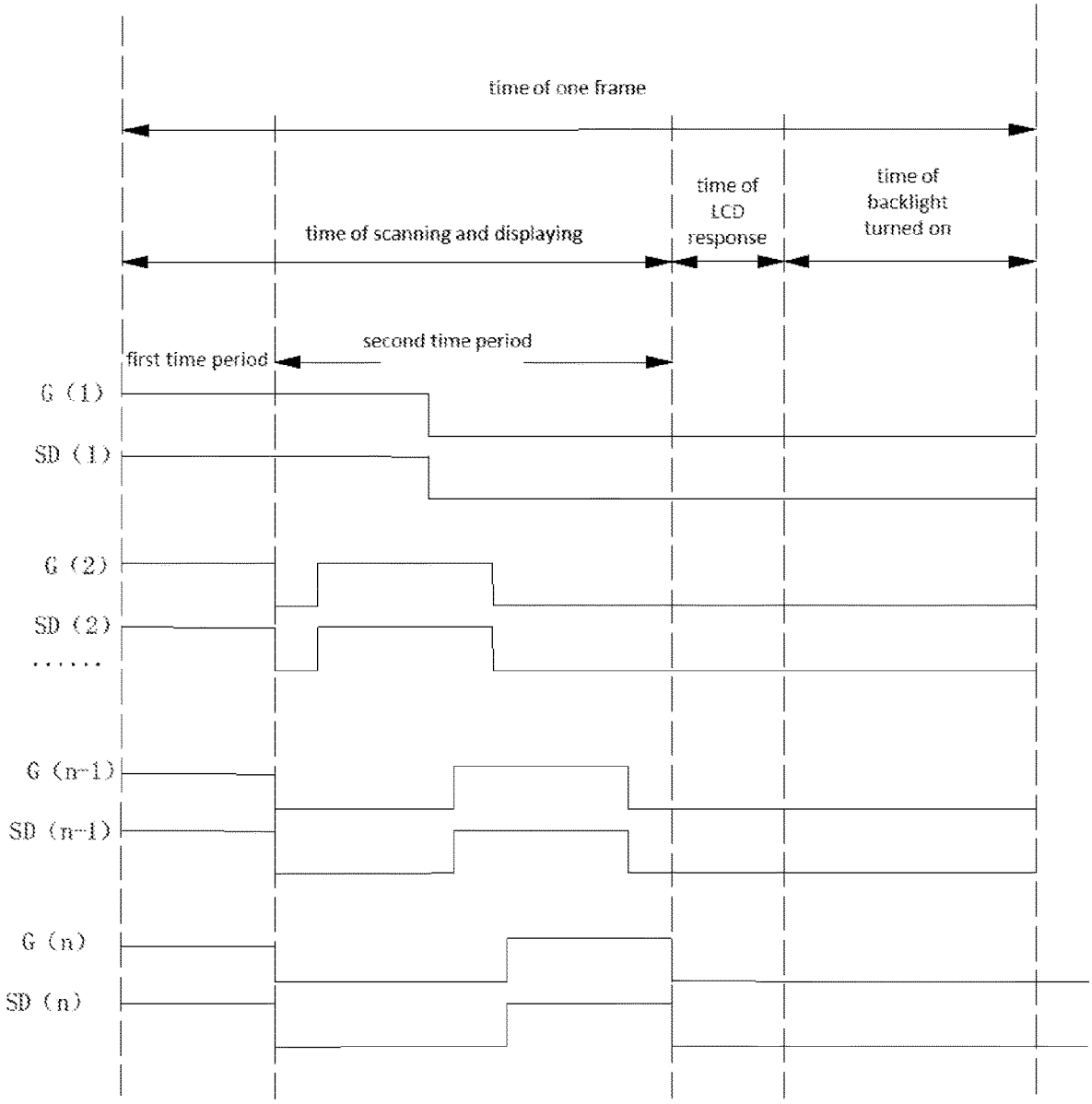
FIG. 5 is a schematic diagram of a time sequence of scan signals and data signals of the display device of the present application during one frame.

Referring to FIG. 4 and FIG. 5, FIG. 4 is a schematic diagram of a time sequence of the display device 100 of the present application during one frame, and FIG. 5 is a schematic diagram of a time sequence of scan signals and data signals of the display device 100 of the present application during one frame. Time of one frame includes a first time period, a second time period, time of liquid crystal display (LCD) response, and time of backlight turned on in chronological order. The first time period is positioned after and adjacent to a frame start signal. The first time period is shorter than the second time period. An all gate on mode of the display device 100 is turned on during the first time period of the next frame when a value of the difference is greater than or equal to the set threshold, and writing the preset gray scale voltage to all sub-pixels 40 of the display device 100 through the data signal in a time of writing a row of data. That is, all sub-pixels 40 of the display device 100 are pre-written to a pure gray scale screen. All gate on mode means setting all scan signals in the gate driving circuit to an active level to simultaneously scan all rows of sub-pixels 40 of the display device 100, and writing scanning signals to the scanning line 10 line by line during the second time period of one frame, and inputting the gray scale voltage of the frame to the sub-pixels 40 through the data line 20. In some embodiments, the first time period is a duration during the display device 100 scanning and writing data signals to one row of sub-pixels 40, and the second time period is a duration during the display device 100 scanning and writing data signals to all rows of sub-pixels 40 line by line.

In some embodiments, the first gray scale value is an average of the gray scale values of last N rows of sub-pixels 40 of the current frame, and the second gray scale value is an average of the gray scale values of last N rows of sub-pixels 40 of the next frame.

In some embodiments, the first gray scale value is a median of gray scale values of last N rows of sub-pixels 40 of the current frame, and the second gray scale value is a median of gray scale values of last N rows of sub-pixels 40 of the next frame.

In some embodiments, the first gray scale value is a gray scale value with a most occurrences in gray scale values of last N rows of sub-pixels 40 of the current frame, and the second gray scale value is a gray scale value with a most occurrences in gray scale values of last N rows of sub-pixels 40 of the next frame. The first gray scale value is any one of a plurality of gray scale values with a most occurrences in the gray scale values of last N rows of sub-pixels 40 of the current frame when there are the plurality of gray scale values with the most occurrences in the gray scale values of last N rows of sub-pixels 40 of the current frame. The second gray scale value is any one of a plurality of gray scale values with a most occurrences in the gray scale values of last N rows of sub-pixels 40 of the next frame when there are the plurality of gray scale values with the most occurrences in the gray scale values of last N rows of sub-pixels 40 of the next frame. The first gray scale value and the second gray scale value both use the gray scale values with the a most occurrences.

In some embodiments, the preset gray scale voltage is a voltage value corresponding to an average of gray scale values of last N rows of sub-pixels 40 of the next frame. The preset gray scale voltage adopts the voltage value corresponding to the average allows for a small difference in the time for each sub-pixel 40 of last N rows of sub-pixels 40 of the next frame to charge to reach the target gray scale voltage.

In some embodiments, the preset gray scale voltage is a voltage value corresponding to a gray scale value with a most occurrences of gray scale values of last N rows of sub-pixels 40 of the next frame. The preset gray scale voltage adopts the voltage value corresponding to the gray scale value with the most occurrences, which means that some sub-pixels 40 in last N rows of sub-pixels 40 of the next frame can reach the target gray scale voltage directly without recharging, which helps to improve a response time of some sub-pixels 40.

In some embodiments, the preset gray scale voltage is a voltage value corresponding to a median of the gray scale values of last N rows of sub-pixels 40 of the next frame. The preset gray scale voltage adopts a voltage value corresponding to the median, which can make the time for each sub-pixel 40 of last N rows of sub-pixels 40 of the next frame to charge to reach the target gray scale voltage not significantly different.

In some embodiments, the first driving mode includes: writing scanning signals to the scanning lines 10 line by line within the next frame, inputting a target gray scale voltage of the next frame to $1^{st}$ to $M\text{-}N^{th}$ rows sub-pixels 40 through the data lines 20, and inputting an overdrive voltage to $M\text{-}N^{th}$ to $M^{th}$ rows sub-pixels 40, wherein an absolute value of the overdrive voltage is greater than an absolute value of a target gray scale voltage of M-N$^{th}$ to M$^{th}$ rows sub-pixels 40 of the next frame, wherein M is a total number of rows of sub-pixels 40, and wherein N and M are positive integers.

Since a liquid crystal response time corresponding to last N rows of sub-pixels 40 of the next frame is less than a liquid crystal response time corresponding to the other rows of sub-pixels 40 of one frame, charging last N rows of sub-pixels 40 of the next frame by using the overdrive voltage is beneficial to reduce the liquid crystal response time corresponding to last N rows of sub-pixels 40 of the next frame, thereby further improving the display device 100 response time. In another embodiment, the first driving mode may also include: inputting the target gray scale voltage of the next frame to 1$^{st}$ to M$^{th}$ rows sub-pixels 40 within the next frame. M is the total number of rows of sub-pixels 40 and M is a positive integer. That is, the target gray scale voltage for the next frame is input directly to all sub-pixels 40 within the next frame, without over-voltage driving.

In some embodiments, N is less than or equal to an integer part of M/2. M is a total number of rows of sub-pixels 40. M is a positive integer. Since in all rows of sub-pixels 40, last M/2 rows of sub-pixels 40 will have insufficient charging time, taking N to be an integer part of M/2 ensures that the liquid crystal corresponding to all sub-pixels 40 can be deflected quickly. Specifically, in this embodiment, N is equal to an integer part of M/2.

In some embodiments, the second driving mode includes: writing scanning signals to the scanning lines 10 line by line within the second time period of the next frame, inputting a target gray scale voltage of the next frame to 1$^{st}$ to M-N$^{th}$ rows sub-pixels 40 through the data lines 20, and inputting an overdrive voltage to M-N$^{th}$ to M$^{th}$ rows sub-pixels 40, wherein an absolute value of the overdrive voltage is greater than an absolute value of a target gray scale voltage of M-N$^{th}$ to M$^{th}$ rows sub-pixels 40 of the next frame, wherein M is a total number of rows of sub-pixels 40, and wherein N and M are positive integers.

That is, the present application first inputs the preset gray scale voltage to the sub-pixels 40 in the first time period of the next frame when the difference is greater than or equal to the set threshold, and the absolute value of the preset gray scale voltage is greater than the absolute value of the first gray scale value corresponding voltage value when the absolute value of the first gray scale value corresponding voltage value is less than the absolute value of the second gray scale value corresponding voltage value. The absolute value of the preset gray scale voltage is less than the absolute value of the voltage value corresponding to the first gray scale value when the absolute value of the first gray scale value corresponding voltage value is greater than the absolute value of the voltage value corresponding to the second gray scale value. During the second time period of the next frame adjacent to the first time period, the target gray scale voltage of the next frame is input to 1$^{st}$ to M-N$^{th}$ rows sub-pixels 40, and the overdrive voltage is input to M-N$^{th}$ to M$^{th}$ rows sub-pixels 40, the absolute value of the overdrive voltage is greater than the absolute value of the target gray scale voltage of M-N$^{th}$ to M$^{th}$ rows sub-pixels 40 of the next frame. M is the total number of rows of sub-pixels 40 and M is a positive integer.

Since the liquid crystal response time corresponding to last N rows of sub-pixels 40 of the next frame is less than the liquid crystal response time corresponding to the other rows of sub-pixels 40 of the next frame, charging last N rows of sub-pixels 40 of the next frame by using the overdrive voltage is conducive to reduce the liquid crystal response time corresponding to last N rows of sub-pixels 40 of the next frame, thereby further improving the response time of the display device 100.

In another embodiment, the second driving mode may also include: In the second time period adjacent to the first time period of the next frame, input the target gray scale voltage of the next frame to 1$^{st}$ to M-N$^{th}$ rows sub-pixels 40. M is the total number of rows of sub-pixels 40, and M is a positive integer. That is, the target gray scale voltage of the next frame is directly input to all the sub-pixels 40 in the second time period, without over-voltage driving.

Figure 6:
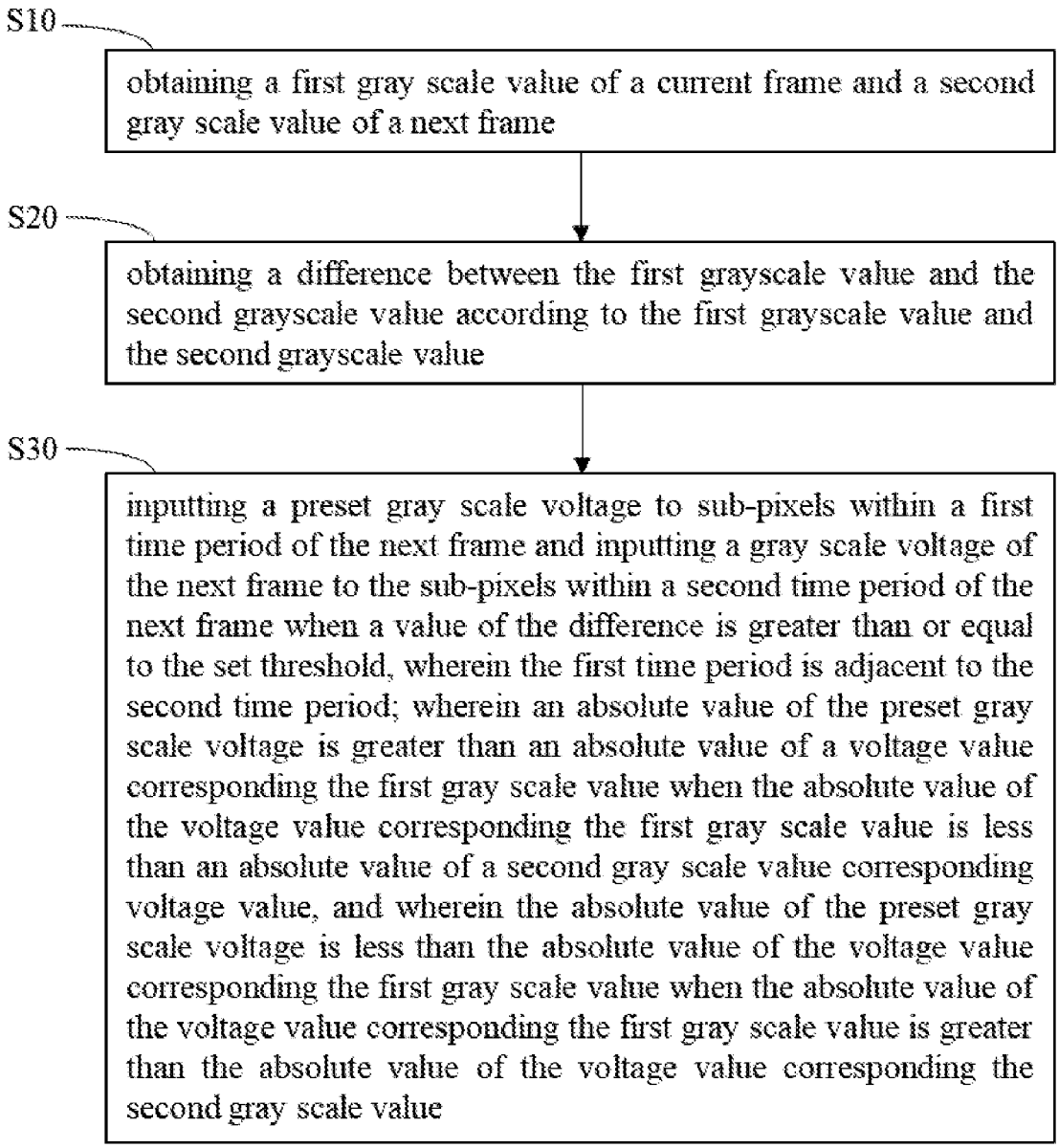
FIG. 6 is a flowchart of a charging method of the sub-pixels provided in the present application.

Referring to FIG. 6, FIG. 6 is a flowchart of a charging method of the sub-pixels 40 provided in the present application. The present application provides the charging method of sub-pixel 40, including the following steps:

S10, obtaining a first gray scale value of a current frame and a second gray scale value of a next frame. The first gray scale value can be an average of the gray scale values of all sub-pixels 40 of the current frame or other gray scale values of the current frame. The first gray scale value can reflect a universal value of the gray scale value of the current frame. The second gray scale value may be an average of the gray scale values of all sub-pixels 40 of the next frame, or may be other gray scale values of the next frame. The second gray scale value can reflect a universal value of the gray scale value of the next frame.

S20, obtaining a difference between the first gray scale value and the second gray scale value according to the first gray scale value and the second gray scale value.

S30, inputting a preset gray scale voltage to sub-pixels 40 within a first time period of the next frame and inputting a gray scale voltage of the next frame to the sub-pixels 40 within a second time period of the next frame when a value of the difference is greater than or equal to the set threshold, wherein the first time period is adjacent to the second time period;

wherein an absolute value of the preset gray scale voltage is greater than an absolute value of a voltage value corresponding the first gray scale value when the absolute value of the voltage value corresponding the first gray scale value is less than an absolute value of a second gray scale value corresponding voltage value, and wherein the absolute value of the preset gray scale voltage is less than the absolute value of the voltage value corresponding the first gray scale value when the absolute value of the voltage value corresponding the first gray scale value is greater than the absolute value of the voltage value corresponding the second gray scale value.

wherein the S30 further includes: inputting the gray scale voltage of the next frame to the sub-pixels 40 during the first time period and the second time period of the next frame when the difference is less than the set threshold.

Referring to FIG. 7, FIG. 7 is a flowchart of one embodiment of step S10 of the charging method of the sub-pixels 40 provided in the present application. Further, in some embodiments, the step S10 includes:

S11, obtaining a gray scale value of last N rows of sub-pixels 40 of the current frame and a gray scale value of last N rows of sub-pixels 40 of the next frame;

S12, obtaining a first gray scale value of the current frame according to the gray scale values of last N rows of sub-pixels 40 of the current frame; and S13, obtaining a second gray scale value of the next frame according to the gray scale values of last N rows of sub-pixels 40 of the next frame;

wherein N is a positive integer.

Still further, in some embodiments, the step S12, including:

obtaining an average of gray scale values of last N rows of sub-pixels 40 of the current frame, wherein the first gray scale value is an average of gray scale values of last N rows of sub-pixels 40 of the current frame; and the step S13 including:

obtaining an average of gray scale values of last N rows of sub-pixels 40 of the next frame, wherein the second gray scale value is an average of gray scale values of last N rows of sub-pixels 40 of the next frame.

Still further, in some embodiments, the step S12, including:

obtaining a median of gray scale values of last N rows of sub-pixels 40 of current frame, wherein the first gray scale value is a median of gray scale values of last N rows of sub-pixels 40 of the current frame; and the step S13 including:

obtaining the median of gray scale values of last N rows of sub-pixels 40 of the next frame, wherein the second gray scale value is a median of gray scale values of last N rows of sub-pixels 40 of the next frame.

Figure 8:
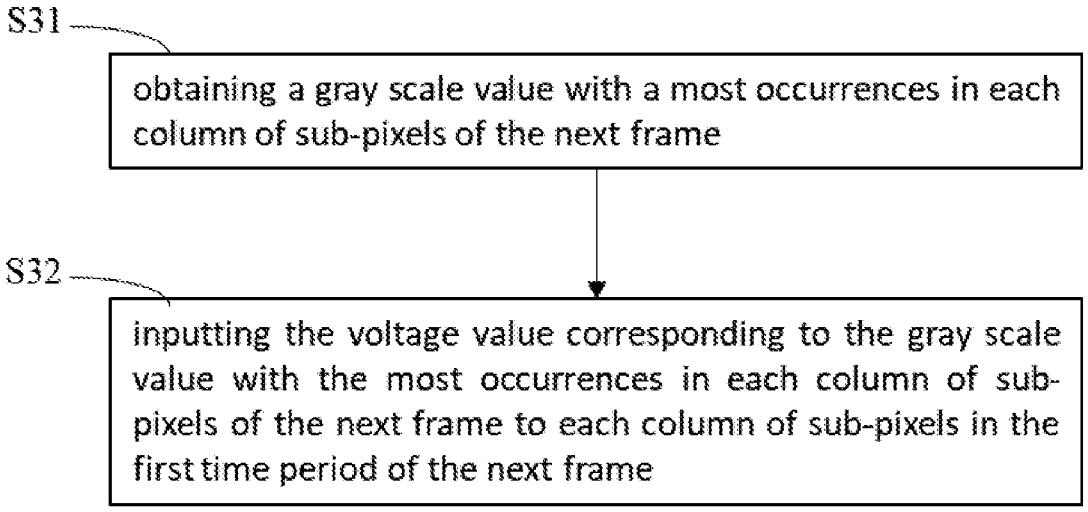
FIG. 8 is a flowchart of a first embodiment of a step of inputting a preset gray scale voltage to the sub-pixel during a first time period of a next frame of the present application.

Referring to FIG. 8, FIG. 8 is a flowchart of a first embodiment of a step of inputting a preset gray scale voltage to the sub-pixel 40 during a first time period of a next frame of the present application. In some embodiments, the step of inputting the preset gray scale voltage to the sub-pixel 40 during a first time period of the next frame, includes:

S31, obtaining a gray scale value with a most occurrences in each column of sub-pixels 40 of the next frame; and S32, inputting the voltage value corresponding to the gray scale value with the most occurrences in each column of sub-pixels 40 of the next frame to each column of sub-pixels 40 in the first time period of the next frame.

That is, obtaining the gray scale value with the most occurrences among the gray scale values of each column of sub-pixels 40 of the next frame first when the difference is greater than or equal to the set threshold, and then inputting the gray scale value with the most occurrences among the gray scale values of each column of sub-pixels 40 of the next frame to each column of sub-pixels 40 during the first time period of the next frame. Since there may be large differences in gray scale values between sub-pixels 40 in each column of sub-pixels 40 of the next frame, the voltage value corresponding to the gray scale value with the most occurrences in each column of sub-pixels 40 is input to each column of sub-pixels 40 separately, so the voltage value corresponding to the gray scale value with the most occurrences among the gray scale values of each column of sub-pixels 40 is input to each column of sub-pixels 40 separately. Therefore, the charging time of some of the sub-pixels 40 in each column of sub-pixels 40 can be reduced, which is conducive to further improve the response time of the display device 100.

Figure 9:
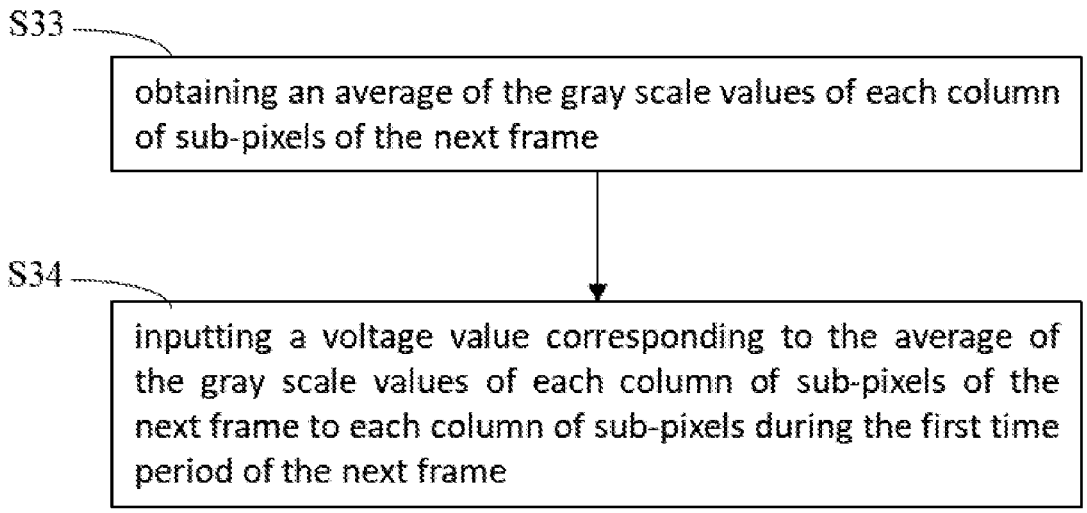
FIG. 9 is a flowchart of a second embodiment of step of inputting the preset gray scale voltage to the sub-pixel during the first time period of the next frame of the present application.

Referring to FIG. 9, FIG. 9 is a flowchart of a second embodiment of step of inputting the preset gray scale voltage to the sub-pixel 40 during the first time period of the next frame of the present application. In some other embodiments, the step of inputting the preset gray scale voltage to the sub-pixel 40 during the first time period of the next frame, includes:

S33, obtaining an average of the gray scale values of each column of sub-pixels 40 of the next frame; and S34, inputting a voltage value corresponding to the average of the gray scale values of each column of sub-pixels 40 of the next frame to each column of sub-pixels 40 during the first time period of the next frame.

Figure 10:
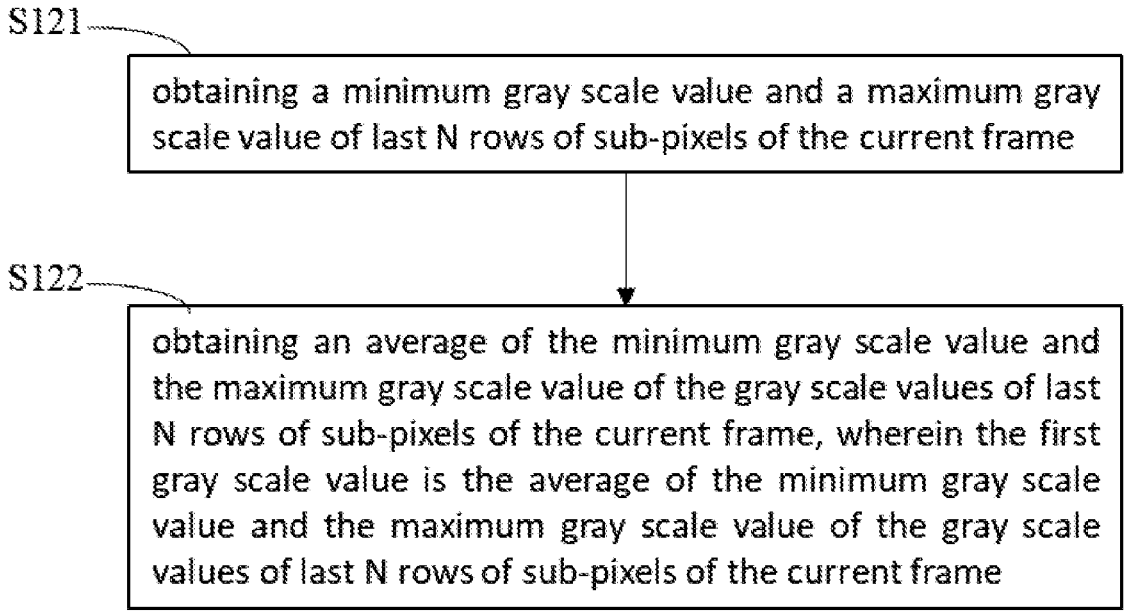
FIG. 10 is a flowchart of one embodiment of step S12 of the charging method of the sub-pixels provided by the present application.
Figure 11:
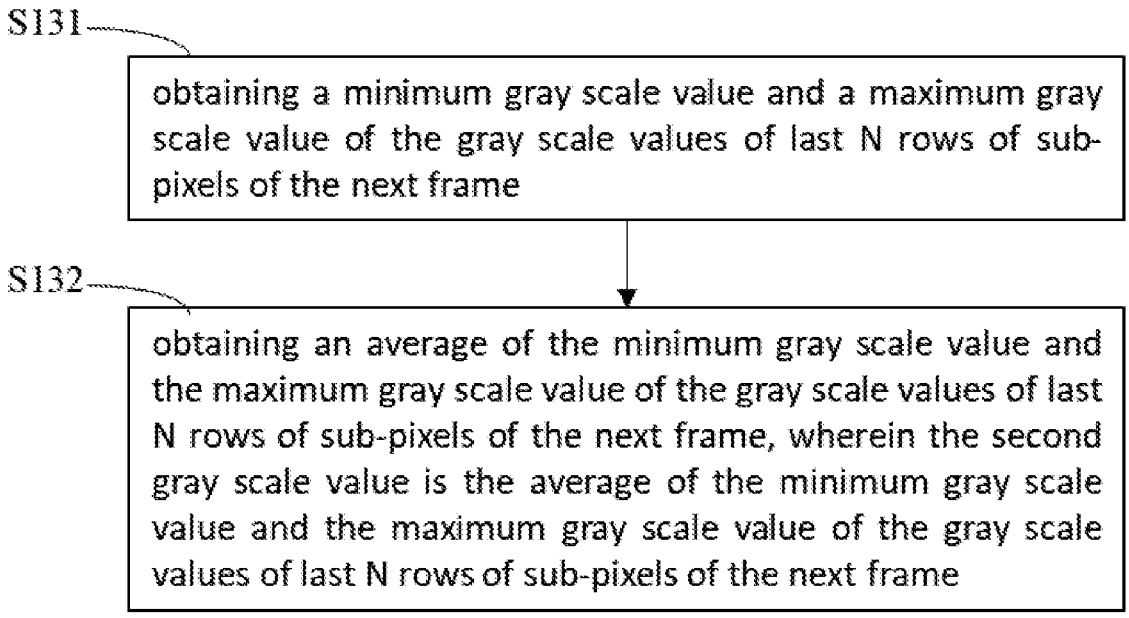
FIG. 11 is a flowchart of one embodiment of step S13 of the charging method of the sub-pixels provided by the present application.

That is, the average of the gray scale value of each column of sub-pixels 40 of the next frame is obtained first when the difference is greater than or equal to the set threshold, and then the average of the gray scale value of each column of sub-pixels 40 of the next frame is input to each column of sub-pixels 40 during the first time period of the next frame. Since there may be a large difference in the gray scale values of different columns of sub-pixels 40 of the next frame, the voltage value corresponding to the average value of the gray scale value of each column of sub-pixels 40 is input to each column of sub-pixels 40 separately, so that the sub-pixels 40 in each column of sub-pixels 40 are charged to reach the target gray scale voltage in a more uniform time, which is conducive to improving the uniformity of the display Referring to FIG. 10 and FIG. 11, FIG. 10 is a flowchart of one embodiment of step S12 of the charging method of the sub-pixels provided by the present application, and FIG. 11 is a flowchart of one embodiment of step S13 of the charging method of the sub-pixels provided by the present application. In some other embodiments of the present application, the step S12 includes:

S121, obtaining a minimum gray scale value and a maximum gray scale value of last N rows of sub-pixels 40 of the current frame;

S122, obtaining an average of the minimum gray scale value and the maximum gray scale value of the gray scale values of last N rows of sub-pixels 40 of the current frame, wherein the first gray scale value is the average of the minimum gray scale value and the maximum gray scale value of the gray scale values of last N rows of sub-pixels 40 of the current frame;

the step S13 including:

S131, obtaining a minimum gray scale value and a maximum gray scale value of the gray scale values of last N rows of sub-pixels 40 of the next frame S132, obtaining an average of the minimum gray scale value and the maximum gray scale value of the gray scale values of last N rows of sub-pixels 40 of the next frame, wherein the second gray scale value is the average of the minimum gray scale value and the maximum gray scale value of the gray scale values of last N rows of sub-pixels 40 of the next frame.

A display device 100 provided by the embodiments of the present application has been introduced in detail above. The principles and implementations of the present application are described in this document by using specific examples. The descriptions of the above embodiments are only used to help understand the methods of the present application and its core idea. At the same time, for those skilled in the art, according to the idea of the present application, there will be changes in the specific implementation and application scope. In conclusion, a content of this specification should not be construed as a limitation to the present application.

What is claimed is:

1. A display device, comprising:

a plurality of scanning lines provided along a first direction;

a plurality of data lines provided along a second direction, wherein the plurality of scanning lines and the plurality of data lines crossing each other and enclosing a plurality of pixel regions, wherein each the pixel region is provided with a sub-pixel, and wherein the sub-pixel is electrically connected to the scanning line and the data line, respectively;

a first driving mode comprising: writing scanning signals line by line to the plurality of scanning lines within a next frame and inputting a gray scale voltage of the next frame to the sub-pixels through the data lines; and a second driving mode comprising: writing scanning signals to all the plurality of scanning lines simultaneously within a first time period of the next frame and inputting a preset gray scale voltage to the sub-pixels through the plurality data lines, and writing scanning signals to the plurality of scanning lines line by line within a second time period of the next frame and inputting the gray scale voltage of the next frame to the sub-pixels through the data lines, wherein the first time period is adjacent to the second time period;

wherein the display device is configured to adopt one of the first driving mode and the second driving mode within one frame;

wherein the display device is configured to adopt the first driving mode within one frame when a difference between a first gray scale value of a current frame and a second gray scale value of the next frame is less than a set threshold;

wherein the display device is configured to adopt the second driving mode within the next frame when the difference between the first gray scale value of the current frame and the second gray scale value of the next frame is greater than or equal to the set threshold; and wherein an absolute value of the preset gray scale voltage is greater than an absolute value of a voltage value corresponding the first gray scale value when the absolute value of the voltage value corresponding the first gray scale value is less than an absolute value of a voltage value corresponding the second gray scale value, and wherein the absolute value of the preset gray scale voltage is less than the absolute value of the voltage value corresponding the first gray scale value when the absolute value of the voltage value corresponding the first gray scale value is greater than the absolute value of the voltage value corresponding the second gray scale value.

2. The display device according to claim 1, wherein the first gray scale value is an average of gray scale values of last N rows of sub-pixels of the current frame, and wherein the second gray scale value is an average of gray scale values of last N rows of sub-pixels of the next frame.

3. The display device according to claim 1, wherein the first gray scale value is a median of gray scale values of last N rows of sub-pixels of the current frame, and wherein the second gray scale value is a median of gray scale values of last N rows of sub-pixels of the next frame.

4. The display device according to claim 1, wherein the first gray scale value is a gray scale value with a most occurrences in gray scale values of last N rows of sub-pixels of the current frame, and wherein the second gray scale value is a gray scale value with a most occurrences in gray scale values of last N rows of sub-pixels of the next frame.

5. The display device according to claim 1, wherein the preset gray scale voltage is a voltage value corresponding to an average of gray scale values of last N rows of sub-pixels of the next frame.

6. The display device according to claim 1, wherein the preset gray scale voltage is a voltage value corresponding to a gray scale value with a most occurrences in gray scale values of last N rows of sub-pixels of the next frame.

7. The display device according to claim 1, wherein the first driving mode comprises: writing scanning signals to the scanning lines line by line within the next frame, inputting a target gray scale voltage of the next frame to $1^{st}$ to M-$N^{th}$ rows sub-pixels through the data lines, and inputting an overdrive voltage to M-$N^{th}$ to $M^{th}$ rows sub-pixels, wherein an absolute value of the overdrive voltage is greater than an absolute value of a target gray scale voltage of M-$N^{th}$ to $M^{th}$ rows sub-pixels of the next frame, wherein M is a total number of rows of sub-pixels, and wherein N and M are positive integers.

8. The display device according to claim 1, wherein the second driving mode comprises: writing scanning signals to the scanning lines line by line within the second time period of the next frame, inputting a target gray scale voltage of the next frame to $1^{st}$ to M-$N^{th}$ rows sub-pixels through the data lines, and inputting an overdrive voltage to M-$N^{th}$ to $M^{th}$ rows sub-pixels, wherein an absolute value of the overdrive voltage is greater than an absolute value of a target gray scale voltage of M-$N^{th}$ to $M^{th}$ rows sub-pixels of the next frame, wherein M is a total number of rows of sub-pixels, and wherein N and M are positive integers.

9. The display device according to claim 2, wherein N is less than or equal to an integer part of M/2, wherein M is a total number of rows of sub-pixels, and wherein M is a positive integer.

10. The display device according to claim 1, wherein the second driving mode comprises: inputting the preset gray scale voltage to each column of the sub-pixels respectively through the data lines, and wherein the preset gray scale voltage is a voltage value corresponding to a gray scale value with a most occurrences in each column of sub-pixels of the next frame.

11. The display device according to claim 1, wherein the second driving mode comprises: inputting the preset gray scale voltage to each column of the sub-pixels respectively through the data lines, and wherein the preset gray scale voltage is a voltage value corresponding to an average of the gray scale values of each column of the sub-pixels of the next frame.

12. A display device, comprising:

a plurality of scanning lines provided along a first direction;

a plurality of data lines provided along a second direction, wherein the plurality of scanning lines and the plurality of data lines crossing each other and enclosing a plurality of pixel regions, wherein each the pixel region is provided with a sub-pixel, and wherein the sub-pixel is electrically connected to the scanning line and the data line, respectively;

a first driving mode comprising: writing scanning signals line by line to the plurality of scanning lines within a next frame and inputting a gray scale voltage of the next frame to the sub-pixels through the data lines; and a second driving mode comprising: writing scanning signals to all the plurality of scanning lines simultaneously within a first time period of the next frame and inputting a preset gray scale voltage to the sub-pixels through the plurality data lines, and writing scanning signals to the plurality of scanning lines line by line within a second time period of the next frame and inputting the gray scale voltage of the next frame to the sub-pixels through the data lines, wherein the first time period is adjacent to the second time period;

wherein the display device is configured to adopt one of the first driving mode and the second driving mode within one frame;

wherein the display device is configured to adopt the first driving mode within one frame when a difference between a first gray scale value of a current frame and a second gray scale value of the next frame is less than a set threshold;

wherein the display device is configured to adopt the second driving mode within the next frame when the difference between the first gray scale value of the current frame and the second gray scale value of the next frame is greater than or equal to the set threshold;

wherein an absolute value of the preset gray scale voltage is greater than an absolute value of a voltage value corresponding the first gray scale value when the absolute value of the voltage value corresponding the first gray scale value is less than an absolute value of a voltage value corresponding the second gray scale value, and wherein the absolute value of the preset gray scale voltage is less than the absolute value of the voltage value corresponding the first gray scale value when the absolute value of the voltage value corresponding the first gray scale value is greater than the absolute value of the voltage value corresponding the second gray scale value; and wherein the first gray scale value is an average of gray scale values of last N rows of sub-pixels of the current frame, and wherein the second gray scale value is an average of gray scale values of last N rows of sub-pixels of the next frame.

13. The display device according to claim 12, wherein the preset gray scale voltage is a voltage value corresponding to an average of gray scale values of last N rows of sub-pixels of the next frame.

14. The display device according to claim 12, wherein the preset gray scale voltage is a voltage value corresponding to a gray scale value with a most occurrences in gray scale values of last N rows of sub-pixels of the next frame.

15. The display device according to claim 12, wherein the first driving mode comprises: writing scanning signals to the scanning lines line by line within the next frame, inputting a target gray scale voltage of the next frame to $1^{st}$ to M-$N^{th}$ rows sub-pixels through the data lines, and inputting an overdrive voltage to M-$N^{th}$ to $M^{th}$ rows sub-pixels, wherein an absolute value of the overdrive voltage is greater than an absolute value of a target gray scale voltage of M-$N^{th}$ to $M^{th}$ rows sub-pixels of the next frame, wherein M is a total number of rows of sub-pixels, and wherein N and M are positive integers.

16. The display device according to claim 12, wherein the second driving mode comprises: writing scanning signals to the scanning lines line by line within the second time period of the next frame, inputting a target gray scale voltage of the next frame to $1^{st}$ to M-$N^{th}$ rows sub-pixels through the data lines, and inputting an overdrive voltage to M-$N^{th}$ to $M^{th}$ rows sub-pixels, wherein an absolute value of the overdrive voltage is greater than an absolute value of a target gray scale voltage of M-$N^{th}$ to $M^{th}$ rows sub-pixels of the next frame, wherein M is a total number of rows of sub-pixels, and wherein N and M are positive integers.

17. The display device according to claim 12, wherein N is less than or equal to an integer part of M/2, wherein M is a total number of rows of sub-pixels, and wherein M is a positive integer.

18. A display device, comprising:

a plurality of scanning lines provided along a first direction;

a plurality of data lines provided along a second direction, wherein the plurality of scanning lines and the plurality of data lines crossing each other and enclosing a plurality of pixel regions, wherein each the pixel region is provided with a sub-pixel, and wherein the sub-pixel is electrically connected to the scanning line and the data line, respectively;

a first driving mode comprising: writing scanning signals line by line to the plurality of scanning lines within a next frame and inputting a gray scale voltage of the next frame to the sub-pixels through the data lines; and a second driving mode comprising: writing scanning signals to all the plurality of scanning lines simultaneously within a first time period of the next frame and inputting a preset gray scale voltage to the sub-pixels through the plurality data lines, and writing scanning signals to the plurality of scanning lines line by line within a second time period of the next frame and inputting the gray scale voltage of the next frame to the sub-pixels through the data lines, wherein the first time period is adjacent to the second time period;

wherein the display device is configured to adopt one of the first driving mode and the second driving mode within one frame;

wherein the second driving mode comprises: writing scanning signals to the scanning lines line by line within the second time period of the next frame, inputting a target gray scale voltage of the next frame to $1^{st}$ to M-$N^{th}$ rows sub-pixels through the data lines, and inputting an overdrive voltage to M-$N^{th}$ to $M^{th}$ rows sub-pixels, wherein an absolute value of the overdrive voltage is greater than an absolute value of a target gray scale voltage of M-$N^{th}$ to $M^{th}$ rows sub-pixels of the next frame, wherein M is a total number of rows of sub-pixels, and wherein N and M are positive integers; and wherein N is less than or equal to an integer part of M/2, wherein M is a total number of rows of sub-pixels, and wherein M is a positive integer.

19. The display device according to claim 18, wherein the display device is configured to adopt the first driving mode within one frame when a difference between a first gray scale value of a current frame and a second gray scale value of the next frame is less than a set threshold;

wherein the display device is configured to adopt the second driving mode within the next frame when the difference between the first gray scale value of the current frame and the second gray scale value of the next frame is greater than or equal to the set threshold; and wherein an absolute value of the preset gray scale voltage is greater than an absolute value of a voltage value corresponding the first gray scale value when the absolute value of the voltage value corresponding the first gray scale value is less than an absolute value of a voltage value corresponding the second gray scale value, and wherein the absolute value of the preset gray scale voltage is less than the absolute value of the voltage value corresponding the first gray scale value when the absolute value of the voltage value corresponding the first gray scale value is greater than the absolute value of the voltage value corresponding the second gray scale value.

* * * * *